US009046901B2

(12) United States Patent
Hamberger et al.

(10) Patent No.: US 9,046,901 B2
(45) Date of Patent: Jun. 2, 2015

(54) DEVICE AND METHOD FOR REDUCING A MAGNETIC UNIDIRECTIONAL FLUX FRACTION IN THE CORE OF A TRANSFORMER

(75) Inventors: Peter Hamberger, Kirchschlag bei Linz (AT); Albert Leikermoser, Salzburg (AT)

(73) Assignee: SIEMENS AKTIENGESELLSCHAFT, München (DE)

( * ) Notice: Subject to any disclaimer, the term of this patent is extended or adjusted under 35 U.S.C. 154(b) by 253 days.

(21) Appl. No.: 13/876,946

(22) PCT Filed: Sep. 29, 2010

(86) PCT No.: PCT/EP2010/064397

§ 371 (c)(1), (2), (4) Date: Mar. 29, 2013

(87) PCT Pub. No.: WO2012/041368

PCT Pub. Date: Apr. 5, 2012

(65) Prior Publication Data

US 2013/0201592 A1 Aug. 8, 2013

(51) Int. Cl.

| | |
|---|---|
| ***G05F 7/00*** | (2006.01) |
| ***H01F 27/38*** | (2006.01) |
| *H01F 27/33* | (2006.01) |
| *H01F 27/42* | (2006.01) |
| *H01F 29/14* | (2006.01) |

(52) U.S. Cl.

CPC . *G05F 7/00* (2013.01); *H01F 27/33* (2013.01); *H01F 27/38* (2013.01); *H01F 27/42* (2013.01); *H01F 2029/143* (2013.01)

(58) Field of Classification Search

CPC ... H01H 53/015; H01H 53/10; G05B 11/012; G01R 1/02; G01R 1/00; G05D 23/208; G05F 7/00

USPC ..... 361/157, 146, 143

See application file for complete search history.

(56) References Cited

U.S. PATENT DOCUMENTS

| | | | | |
|---|---|---|---|---|
| 4,346,340 | A * | 8/1982 | Hackett-Jones | 323/249 |
| 2004/0196675 | A1 * | 10/2004 | Cope et al. | 363/39 |

FOREIGN PATENT DOCUMENTS

| | | | |
|---|---|---|---|
| DE | 3631438 | A1 | 3/1988 |
| DE | 4021860 | C2 | 8/1996 |
| GB | 2013000 | A | 8/1979 |
| WO | WO 2004013951 | A2 | 2/2004 |
| WO | WO 2008151661 | A1 | 12/2008 |

* cited by examiner

*Primary Examiner* — Jared Fureman
*Assistant Examiner* — Nicholas Ieva

(57) ABSTRACT

A device for reducing a magnetic unidirectional flux fraction in the core of a transformer is provided. The device has a measuring device that provides a sensor signal corresponding to the magnetic unidirectional flux fraction, a compensation winding that is magnetically coupled to the core of the transformer, a switching unit arranged electrically in a current path in series with the compensation winding in order to feed a current into the compensation winding. The action of the current is directed opposite to the unidirectional flux fraction. The switching unit can be controlled by a regulating variable provided by a control device and can be switched into a conductive state during a predefined time interval and in accordance with the regulating variable, the switch-on time being mains-synchronous. A device for limiting the current in the current path is provided and the sensor signal is fed to the control device.

17 Claims, 2 Drawing Sheets

Figure 1:
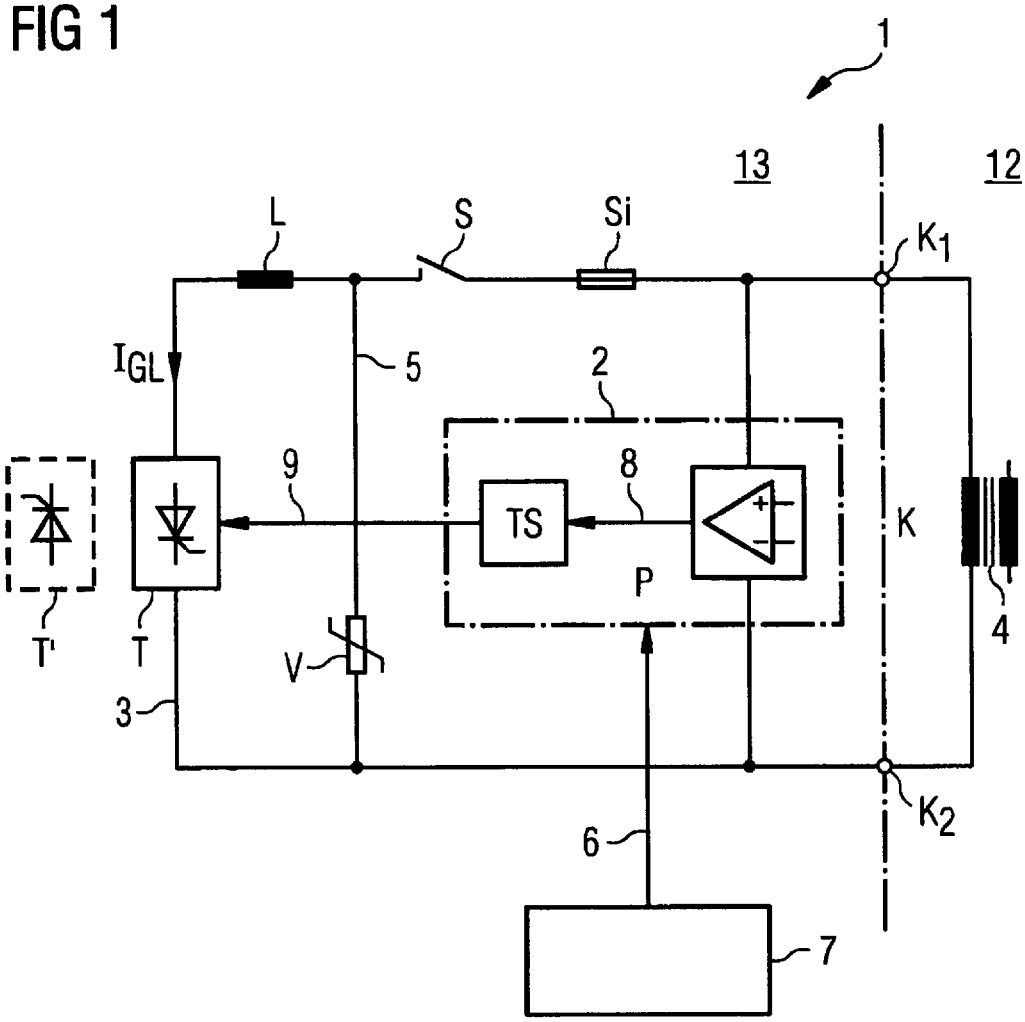

DEVICE AND METHOD FOR REDUCING A MAGNETIC UNIDIRECTIONAL FLUX FRACTION IN THE CORE OF A TRANSFORMER

CROSS REFERENCE TO RELATED APPLICATIONS

This application is the US National Stage of International Application No. PCT/EP2010/064397 filed Sep. 29, 2010 and claims the benefit thereof. The application is incorporated by reference herein in its entirety.

FIELD OF THE INVENTION

The invention relates to a device and a method for reducing a magnetic unidirectional flux fraction in the core of a transformer with a measuring device, which provides a sensor signal corresponding to the magnetic unidirectional flux fraction, with a compensation winding, which is coupled magnetically to the core of the transformer, with a switching unit, which is arranged electrically in a current path in series with the compensation winding in order to feed a current into the compensation winding, wherein the action of said current is directed opposite to the unidirectional flux fraction, wherein the switching unit can be controlled by means of a regulating variable provided by a control device; the present invention also provides a method for retrofitting a transformer.

BACKGROUND OF THE INVENTION

Electrical transformers, such as those used in energy distribution networks can be subject to the unwanted injection of a direct current into the primary winding or secondary winding. The injection of a direct current of this kind, hereinafter also referred to as the DC component, can, for example, originate from electronic structural components, such as are used nowadays to control electric drives or even for power-factor compensation. Another cause could be so-called "geomagnetically induced currents" (GIC).

In the core of the transformer, a DC component results in a unidirectional flux fraction, which superimposes the alternating flux. This results in an asymmetrical control of the magnetic material in the core and is associated with a series of drawbacks. Even a direct current in the order of a few amperes can cause local heating in the transformer, which can impair the lifetime of the winding insulation. A further unwanted effect is increased noise emission during the operation of the transformer. This is in particular perceived as a nuisance if the transformer is installed in the vicinity of a residential area.

Various mechanisms that work actively and passively to reduce the operating noise of a transformer are known. For example, it is proposed in DE 40 21 860 C2 that noise emission be counteracted at its point of origin, namely that the magnetic action of the injection DC component should be controlled directly. To this end, an additional winding is attached to the transformer, a so-called compensation winding. This compensation winding, which usually has only a low number of turns, is fed with a compensation current, wherein the magnetic action of said compensation current is aligned such that it is directed opposite to the magnetic flux of the disruptive DC component in the core of the transformer. The injected direct current is set in accordance with an adjuster or a control device in conjunction with an assigned detecting element, for example a microphone. However, a measuring device of this kind does not meet the requirements for reliability and the desired lowest possible maintenance costs, which are nowadays imposed on transformers in an energy distribution network.

In order to detect the unidirectional flux fraction in the core of a transformer as reliably as possible, the unpublished PCT/EP2010/054857 suggests a sensor mechanism which operates as a kind of "magnetic bypass": by means of a ferromagnetic shunt part, a portion of the main magnetic flux is branched off at the transformer core and fed downstream again. This branched-off flux component bypassing the core is used to determine the magnetic field strength in the core section bypassed by the shunt arm either directly or indirectly from a physical variable derived therefrom. This detection of the magnetic field strength, or magnetic excitation, is more reliable and more suitable for long-term use.

Known from WO 2004/013951 A2 is a semiconductor switching unit by means of which a compensation current is fed into a compensation winding of a transformer for purposes of DC minimization. A control device with an independent energy source sets a controllable frequency for the duration of the current flow of the semiconductor switch (MOSFET). In this context, the electrical energy for the generation of the compensation current is taken from a capacitor which is charged cyclically via the MOSFET free-wheeling circuit. However, in the case of transformers such as those used in an energy distribution network, a capacitor is not desirable as an energy store for reasons of reliability and due to the desire for low-maintenance long-term operation.

SUMMARY OF THE INVENTION

It is an object of the present invention to disclose a device and a method for reducing a direct component of a magnetic flux in a transformer, which is more suitable in practical use for transformers in an energy distribution network. The invention also relates to a method for the retrofitting of a transformer.

This object is achieved with respect to a device and with respect to a method and by a method for retrofitting a transformer with the features of independent claims. Advantageous embodiments, aspects and details of the invention can be derived from the dependent claims, the description and the attached drawings.

The invention is based on the concept of using the electric voltage induced in the compensation winding and employing it for the compensation of the disruptive magnetic unidirectional flux fraction. According to the invention, an electronic switching unit generates a compensation current, wherein the switching-on of the switching unit takes place mains-synchronously and in accordance with a predetermined switching strategy. According to the invention, the switch-on time is triggered by the phase of the voltage induced in the compensation winding and the ON-duration is established in accordance with a sensor signal provided by a measuring device. In this way, a sinusoidal pulsating direct current is fed into the compensation winding, wherein the size of said current is limited by a current-limiting mechanism. No energy source, i.e. a battery or a capacitor, is required to generate this pulsating direct current. The duration of the current flow of this pulsating direct current can be set in a simple way and very precisely in accordance with the sensor signal supplied which specifies the direction and size of the DC component to be compensated. The mean value of this pulsed direct current generated in this way causes a reduction of the unidirectional flux fraction in the soft-magnetic core of the transformer or completely neutralizes its action in the core. As a result, there is no longer any unwanted asymmetrical control of the soft-magnetic core. As a consequence, the thermal loading of the winding of the transformer is reduced. Losses and noises during the operation of the transformer are reduced. This enables the device to be implemented with relatively simple means. At the same time, it is possible for both discrete and/or programmable modules to be used and these are commercially available. Here, it is of great advantage that no energy store, such as, for example a battery or a capacitor is required for the generation of the compensation current. The energy for the generation of the compensation current is taken directly from the compensation winding. Due to its simplicity, the circuit arrangement is extremely reliable. It is well suited for the low-maintenance long-term operation of a transformer in an energy distribution network. The field of application includes both transformers in the low- or medium-voltage range and very powerful transformers. Neither the size nor safety-relevant units or other design criteria of the transformer are influenced unfavorably by the use of the invention.

Here, it can be of particular advantage if, for purposes of limiting the current, an inductance is arranged in the current path in series with the switching unit and the compensation winding. The fact that the coil current of the compensation winding corresponds to the temporal integral of the coil voltage and hence DC components of this voltage integral and hence of the coil current can be achieved over a period in a simple way by a suitable control strategy, is sufficient evidence of the advantage of using an inductance in the current path. With a suitable choice of inductance, the loading on switching-on can be kept very low since the temporal change in the current at the moment of switching-on is limited by the inductance. It is in principle also possible to use another two-terminal network instead of the inductance. From the viewpoint of circuit engineering, an ohmic resistance would also be conceivable, although its active power losses would be of disadvantage.

One embodiment that can be favorable from the viewpoint of circuit engineering is an embodiment with which the control device substantially comprises two function blocks, a phase detector and a timing element. The phase detector detects the zero passage of the electric voltage induced in the compensation winding and supplies the trigger signal for the switch-on time of the time interval, the duration of which is predetermined in accordance with the sensor signal.

A further protective measure to protect the switching mechanism from inductive voltage peaks can consist in the fact that overvoltage protection is provided in parallel to the series connection of the inductance and switching unit in a parallel branch circuit.

In a quite particularly preferred embodiment, the switching unit is formed from at least one thyristor. The advantage of using a thyristor initially consists in the fact that a thyristor is "ignited" by a current pulse, i.e. can be transferred to a conductive state. During the positive half-wave of the mains voltage, the thyristor has the property of a diode until the next current zero. The end of the duration of the current flow is effected by the thyristor itself in that the holding current is undershot and the thyristor automatically "clears", i.e. transfers to the non-conductive state. Obviously, other semiconductor switches, such as GTO, IGBT transistors or other switching elements are also conceivable.

There are various circuit variants enabling a direct current to be injected in the compensation winding in both current directions. Two compensation windings wound in opposition to each other, in each case in conjunction with a unipolar semiconductor switch, or one winding with bipolar semiconductor switches could be used. In principle, it could also be possible to use a polarity reversal circuit. However, it is possible to achieve a particularly simple implementation by means of an antiparallel connection of two switching units, in particular two antiparallel thyristors.

It can be advantageous for a switch for switching on and off and a fuse limiting the current flow to be provided in the current path. This can enable the compensation mechanism to be activated or deactivated. In the event of a fault, the fuse ensures the limitation of an impermissibly high current.

It can be favorable for the switching unit and the control device to be arranged outside the tank of a transformer. This makes the entire electronic circuit accessible from the exterior for inspection and maintenance.

A quite particularly preferred embodiment of the invention can consist in the fact that the measuring device comprises a magnetic shunt part with a sensor coil for detecting the magnetic unidirectional flux fraction. The shunt part is arranged on the core of the transformer, for example lying on a limb or on a yoke, so that a part of the magnetic flux bypasses said core. It is very easy to obtain a sensor signal with long-term stability from this magnetic flux diverted by the shunt by means of a sensor coil, wherein said sensor signal, optionally, after signal conditioning, depicts the unidirectional flux fraction (DC component) very well. The measuring result is to a large extent free of drift and has long-term stability. Since this detector substantially comprises the shunt part and the sensor coil arranged thereon, it is highly reliable.

The object described in the introduction is also achieved by a method which is characterized in that the switch-on time of the switching unit occurs synchronously to the voltage induced in the compensation winding and in accordance with a sensor signal, wherein the sensor signal is supplied by a measuring device for detecting the magnetic unidirectional flow component of the control device. From the viewpoint of circuit engineering, a method of this kind is very simple to implement with just a few components.

A favorable embodiment of the method can be such that the switching unit is controlled by a regulating variable, which is predetermined by a timing element disposed in the control device, wherein the timing element is triggered by a phase detector, which detects the phase of the voltage induced in the compensation winding. The timing element can be embodied as a discrete module or part of a digital circuit. It can be advantageous for the regulating variable to be the result of a computer operation of a microprocessor. Here, the microprocessor can simultaneously be used for the signal conditioning of the sensor signal.

In a particularly preferred embodiment, the switching unit is controlled such that a pulsating direct current is fed into the compensation winding. This has the advantage that the arithmetic mean value of this pulsating direct current can be predetermined very simply in accordance with the DC component to be compensated. Advantageously, for the purposes of reducing the magnetic energy stored in the inductance, the electronic switching unit remains switched on until the pulsating direct current has decayed. Hence, when the electric switching unit has switched off, an overvoltage protection is required to absorb virtually no residual magnetic energy stored in the coil.

Also disclosed for the achievement of above-described object is a method for retrofitting a transformer. The device according to the invention or the method according to the invention can advantageously be used with transformers which are already in operation. Here, the expenditure is very low. Retrofitting is in particular very simple if a compensation winding according to the present invention already arranged in the transformer tank can be used. In this case, the transformer tank does not need to be opened; instead the mechanism according to the invention only needs to be connected to terminals of the compensation winding already described.

BRIEF DESCRIPTION OF THE INVENTION

Figure 2:
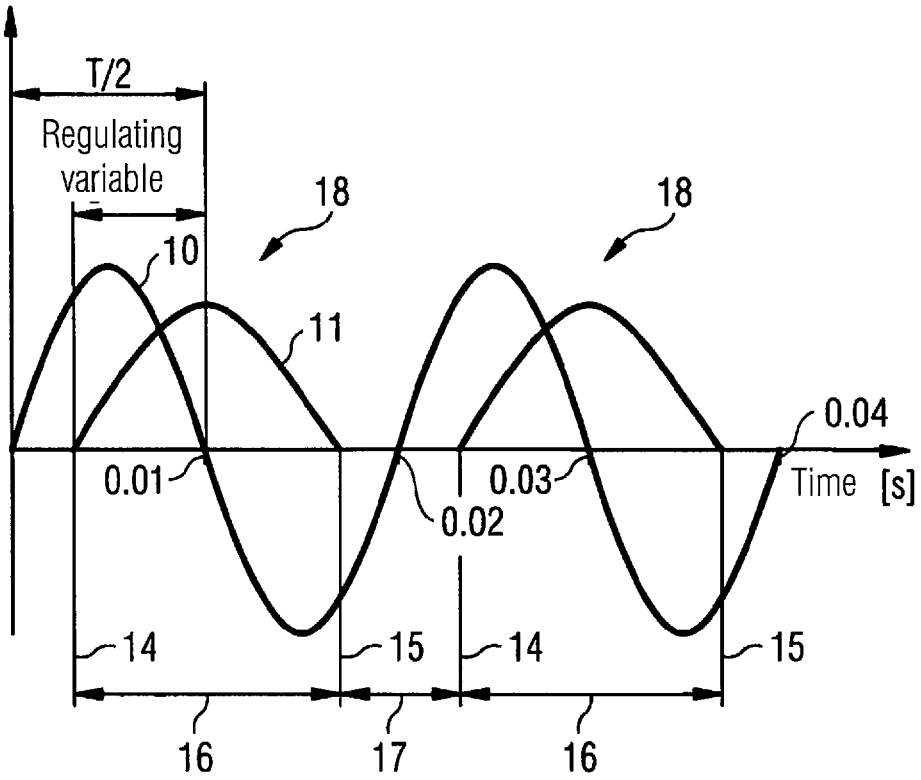
Figure 3:
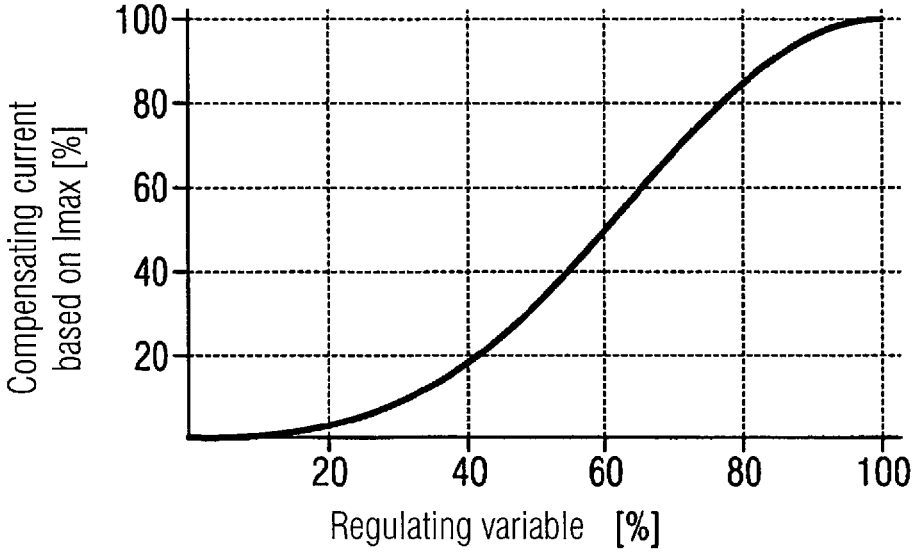

For a further explanation of the invention, the following part of the description refers to the drawings, from which further advantageous embodiments, details and developments of the invention may be derived with reference to a non-restrictive exemplary embodiment. The drawing shows:

FIG. 1 an exemplary embodiment of the device according to the embodiment, shown in a simplified sketch;

FIG. 2 a depiction of the temporal course of the electric voltage of the compensation current induced in the compensation winding;

FIG. 3 a depiction of the compensation current as a function of the regulating variable.

DETAILED DESCRIPTION OF THE INVENTION

FIG. 1 shows a device 1 according to an exemplary embodiment of the invention in a simplified depiction. The device 1 substantially comprises a circuit arrangement connected via the terminals K1 and K2 to a compensation winding arrangement K. The compensation winding arrangement K is housed in the transformer tank 12 and magnetically coupled to the core 4 of the transformer. It usually only comprises a winding with a low number of turns, which is, for example, wound around a limb or a yoke part of the transformer. From the compensation winding K in the transformer tank 12, the connections on the terminals K1 and K2 are led out into the outer area 13.

During the operation of the transformer, an electric voltage is induced in the compensation winding K, said voltage being used according to the invention to combat the disruptive direct component of the magnetic flux in the core 4. This is performed by line-commutated switching of a switching unit T.

The following explains in more detail how the course of the compensation current shown in FIG. 2 is generated:

As can be derived from the illustration in FIG. 1, the terminals K1 and K2 of the compensation winding K are connected to a control device 2. The control device 2 substantially comprises a phase detector P and a timing element TS. The phase detector P, for example a zero passage detector, derives a trigger signal 8 from the induced voltage, which is fed to a timing element TS. Together with a control signal 6, which is also fed to the control device 2, the control device 2 provides a regulating variable 9 on the output side, which is fed to an electronic switching unit T. The switching unit T lies in a current path 3 in series with the compensation winding K and in series with an inductance L. Here, the dimensions of the inductance L are such that, when the switching unit T is switched through, a sinusoidal pulsating current flow flowing in a current direction is fed into the compensation winding K.

A fuse Si is provided in the current path 3 for the purposes of limiting the current. In FIG. 1, this fuse Si is arranged between the terminal K1 and a switch S. The switch S serves to close or separate the current path 3.

According to the invention, the switching-on of the electronic switching unit T is performed phase-synchronously to the voltage in the compensation winding K and in accordance with a determined switching strategy. That is, depending on the size and direction of the compensation current to be introduced, the switch-on time is controlled with the aid of the timing element TS controlled by the phase detector P in accordance with a functional relationship explained in further detail below such that the action of the resultant arithmetic mean value of the pulsating current in the compensation winding K reduces or completely compensates the disruptive unidirectional flux fraction.

The control device 2 receives the information relating to the size and direction of the DC field to be compensated in the core 4 from a measuring device 7 for measuring the unidirectional flux fraction. This provides the sensor signal 6 which is fed to the control device 2. Particularly advantageously, the measuring device 7 works according to the magnetic bypass measuring principle (PCT/EP2010/054857) mentioned in the introduction. That is, it substantially comprises a magnetic shunt part, which is arranged on the core in order to divert a component of the magnetic flux, from which the unidirectional component can then be determined, for example with a sensor coil arranged on the shunt part in conjunction with signal conditioning.

The electronic switching unit T is switched off on zero passage of the current (see FIG. 2). This time is very simple to determine since the duration of the current flow 16 corresponds to double the regulating variable x (signal 9 in FIG. 2). The result of this is that the overvoltage protection V provided in the parallel circuit 5 only has to absorb a low amount of residual magnetic energy on switching off. The switching losses of the electronic switching unit are minimal, since on switching-on, due to the inductance L in the current path 3, the switch-on current is low; the switching losses are also low on switching off, since the switch-off time is defined such that it occurs on zero passage or at least close to zero current in the current path 3.

Hence, the arithmetic mean value of the compensation current $I_{GL}$ is solely determined by the switch-on time determined by the regulating variable. Thyristors are particularly suitable as switches for the switching unit T, since, as a matter of principle, on achieving de-energized state, or to be more precise, on undershooting the so-called withstand current, they return to the non-conductive state of their own accord.

Since the switch-on time is determined by the signal 9 determined and is mains-synchronous and since the switching-off of the switching unit T is performed on zero passage of the current, the arithmetic mean value of the compensation current $I_{GL}$ can be set very precisely by the regulating variable x or the regulating variable signal 9.

FIG. 2 shows the temporal course of the voltage 10 induced in the compensation winding K and the pulsating direct current 11 (compensation current $I_{GL}$) determined by the switching strategy according to the invention. The compensation current $I_{GL}$ has the shape of sequential half-waves 18, which are interrupted by current gaps 17, wherein each half-wave 18 is symmetrical to the half period T/2 of the induced voltage 10. The switch-on time 14 is, as shown above, in synchronism with the mains and determined in accordance with the regulating variable 9. In FIG. 2, the synchronization time for the switching-on is the falling zero passage of the voltage 10. By means of a suitable choice of the inductance L, after the switching-through of the switching unit T, the current in the current path 3 follows the integral of the electric voltage 10, i.e., it has its maximum value on the zero passage of the electric voltage 10 and then subsides again. If the compensation current 11 is close to zero, the switching unit T, for example a thyristor, changes to the non-conductive state. The duration of the current flow 16 is determined by the regulating variable 9 or by the turning-off of the thyristor. Each half-wave 18 is followed by a current gap 17.

In order to specify a compensation current $I_{GL}$ in both directions in the winding K, in FIG. 1 a second switching unit T' is indicated by a broken line. The two switching units T and T' can, for example, be two antiparallel thyristors.

There is a nonlinear relationship between the compensation current $I_{GL}$ generated and the regulating variable x—this relationship is depicted graphically in FIG. 3 and explained in more detail below:

In the following consideration, it is assumed that the ohmic resistance of the coil can be ignored.

Hence, the following approximates the functional relationship between the coil current $I_L$ (t) and the coil voltage $U_L$(t):

$$[I_L(t)-I_L(t=0)]=[1/L]\cdot\int[I_L(t)\cdot dt] \quad (1)$$

If now:

T:=duration of the voltage at the compensation winding [s] $\hat{U}$: =peak value of the voltage at the compensation winding [V]

L:=inductance of the coil [H]

x:=regulating variable in percentage [%]

and if, further, the time t is defined by:

$$t = x\cdot\frac{T}{2}\cdot\frac{1}{100} \quad (2)$$

the maximum achievable arithmetic mean value (direct component) of the coil current or of the compensation current $I_{MAX}$ with a regulating variable of 100 percent is:

$$I_{MAX} = \frac{\hat{U}}{L}\cdot\frac{T}{2\pi}. \quad (3)$$

After an intermediate calculation, the arithmetic mean value (direct component) of the coil current or compensation current $I_{GL}$ [A] as a function of the regulating variable x [%] amounts to:

$$I_{GL} = I_{MAX}\frac{T\sin\left(\frac{2\pi t}{T}\right)-2\pi t\cos\left(\frac{2\pi t}{T}\right)}{\pi\cdot T} \quad (4)$$

The effective value of the fundamental wave components $I_{QW}$ obtained in the compensation current [$A_{EFF}$] as a function of the regulating variable x [%] is:

$$I_{GW} = I_{MAX}\frac{T\sin\left(\frac{4\pi t}{T}\right)-4\pi t}{2\pi T\sqrt{2}} \quad (5)$$

In addition, the following applies for the effective value of the spectral component $I_{0w}$ obtained in the compensation current signal [$A_{EFF}$] of the (k)-th harmonic as a function of the regulating variable x [%]:

$$I_{OW} = I_{MAX}\frac{\cos(k\pi)\left[(1+k)\sin\left(\frac{2\pi t(k-1)}{T}\right)-(k-1)\sin\left(\frac{2\pi t(k+1)}{T}\right)\right]}{k(k^2-1)\pi\sqrt{2}} \quad (6)$$

where: k∈N and k≥2

FIG. 3 shows the functional relationship between the compensation current $I_{GL}$ (based on the maximum achievable compensation current $I_{MAX}$ at 100 percent) in dependence on the regulating variable corresponding to equation (4).

If the size and direction of the unidirectional flux fraction to be compensated is known (sensor signal 6), the control device according to the above depiction or the relationship shown in FIG. 3 determines the regulating variable x (signal 9) required for the compensation. This enables the thermal loading of the winding and the disruptive emission of noise to be reduced in a simple way in the case of a transformer. The above-explained electronic circuit can be potential-free. This means that no insulation problems occur even in the field of application of high mains voltages.

The invention claimed is:

1. A device for reducing a magnetic unidirectional flux fraction in a core of a transformer, comprising:

a measuring device that provides a sensor signal corresponding to the magnetic unidirectional flux fraction;

a compensation winding that is coupled magnetically to the core of the transformer;

a switching unit that is arranged electrically in a current path in series with the compensation winding in order to feed a current into the compensation winding; and a control device that provides a regulating variable, wherein an action of the current is directed opposite to the unidirectional flux fraction, wherein the switching unit is controlled by the regulating variable, wherein the switching unit is switched into a conductive state during a predefined time interval with a mains-synchronous switch-on time and in accordance with the regulating variable, wherein a mechanism for limiting the current in the current path is provided, and wherein the sensor signal is fed to the control device.

2. The device as claimed in claim 1, wherein the mechanism for limiting the current is formed by an inductance in the current path connected in series to the compensation winding unit and to the switching unit.

3. The device as claimed in claim 1, wherein the control device comprises a mechanism for detecting a phase of a voltage in the compensation winding unit and a mechanism for setting the predefined time interval.

4. The device as claimed in claim 1, wherein the switching unit is controlled such that the current flowing in the current path is a pulsating direct current and switches the switching unit off when the current in the current path is zero or almost zero.

5. The device as claimed in claim 4 wherein the pulsating direct current is formed from periodically recurring half-waves and from current gaps connecting adjacent half-waves.

6. The device as claimed in claim 1, wherein the switching unit is formed from at least one semiconductor switch.

7. The device as claimed in claim 6, wherein the switching unit is formed from at least one thyristor, GTO or IGBT.

8. The device as claimed in claim 6, wherein the switching unit is formed from two thyristors in antiparallel connection.

9. The device as claimed in claim 1, wherein a fuse and a switch are arranged in the current path.

10. The device as claimed in claim 1, wherein the measuring device comprises a magnetic shunt part with a sensor coil, and wherein the magnetic shunt part is arranged on the core of the transformer so that it is bypassed by part of the magnetic flux and the sensor signal is derived from an induced voltage in the sensor coil or formed therefrom.

11. A method for reducing a magnetic unidirectional flux fraction in a core of a transformer, comprising:

coupling a compensation winding unit to the core;

arranging a switching unit in a current path in series with the compensation winding unit;

controlling the switching unit by a control device for feeding a compensation current into the compensation winding unit;

directing an action of the compensation current in the core opposite to the unidirectional flux fraction;

limiting the current flowing in the current path by a current-limiting mechanism;

providing a sensor signal by a measuring device for detecting the magnetic unidirectional flux fraction;

feeding the sensor signal to the control device; and synchronously switching the switching unit to a voltage induced in the compensation winding unit in accordance with the sensor signal to a switch-on time.

12. The method as claimed in claim 11, wherein the current-limiting mechanism is formed by an inductance in the current path connected in series to the compensation winding unit and to the switching unit.

13. The method as claimed in claim 11, wherein the switching unit is controlled by a regulating variable that is issued by a timing element disposed in the control device, and wherein the timing element is triggered by a phase detector that detects a phase of the induced voltage in the compensation winding unit.

14. The method as claimed in claim 11, wherein the switching unit is controlled such that a pulsating direct current is fed into the compensation winding unit.

15. The method as claimed in claim 14, wherein the pulsating direct current is formed by periodically recurring sinusoidal half-waves and intermediate current gaps.

16. The method as claimed in claim 15, wherein the switching unit is switched off in a de-energized state at an end of a half-wave.

17. The method as claimed in claim 11, wherein the switching unit comprises at least one thyristor and is switched-off by an undershooting of a holding current of the at least one thyristor.

* * * * *